US007334886B2

(12) United States Patent
Papaiacovou et al.

(10) Patent No.: US 7,334,886 B2
(45) Date of Patent: Feb. 26, 2008

(54) BULK INK DELIVERY SYSTEM FOR INK JET PRINTERS AND THE LIKE

(75) Inventors: Iacovos Papaiacovou, Huntington, NY (US); Thomas S. Youhas, Scotts Valley, CA (US); Donald H. Balbinder, Nissequogue, NY (US); Daniel Slep, Setauket, NY (US); Martin McDonough, Ronkonkoma, NY (US); Christopher M. McGinnis, Aptos, CA (US)

(73) Assignee: Hilord Chemical Corporation, Hauppauge, NY (US)

( * ) Notice: Subject to any disclaimer, the term of this patent is extended or adjusted under 35 U.S.C. 154(b) by 9 days.

(21) Appl. No.: 11/168,063

(22) Filed: Jun. 28, 2005

(65) Prior Publication Data

US 2006/0001684 A1 Jan. 5, 2006

Related U.S. Application Data

(60) Provisional application No. 60/585,165, filed on Jul. 2, 2004.

(51) Int. Cl.
*B41J 2/175* (2006.01)

(52) U.S. Cl. ..... 347/85; 347/84; 347/86; 347/6; 347/7

(58) Field of Classification Search ..... 347/85
See application file for complete search history.

(56) References Cited

U.S. PATENT DOCUMENTS

| | | | | |
|---|---|---|---|---|
| 4,769,650 | A * | 9/1988 | Peng et al. | 347/4 |
| 5,369,429 | A | 11/1994 | Erickson | 347/7 |
| 5,751,319 | A | 5/1998 | Robertson et al. | 347/85 |
| 5,912,688 | A * | 6/1999 | Gragg | 347/86 |
| 6,030,074 | A | 2/2000 | Barinaga | 347/85 |
| 6,109,740 | A | 8/2000 | Namekawa et al. | 347/85 |
| 6,170,937 | B1 | 1/2001 | Childers et al. | 347/85 |
| 6,183,073 | B1 | 2/2001 | Rottman et al. | 347/85 |
| 6,283,586 | B1 | 9/2001 | Childers | 347/85 |
| 6,431,680 | B1 * | 8/2002 | Shinada | 347/19 |
| 6,467,888 | B2 * | 10/2002 | Wheeler et al. | 347/85 |
| 6,698,869 | B2 * | 3/2004 | Vosahlo | 347/85 |
| 2002/0047882 | A1 * | 4/2002 | Karlinski et al. | 347/85 |
| 2004/0125182 | A1 | 7/2004 | Akermalm | 347/85 |
| 2004/0263589 | A1 * | 12/2004 | Ansier et al. | 347/85 |

* cited by examiner

*Primary Examiner*—Lamson Nguyen
*Assistant Examiner*—Brian J. Goldberg
(74) *Attorney, Agent, or Firm*—Gerald T. Bodner

(57) ABSTRACT

A bulk ink delivery system for ink jet printers and the like includes one or more cartridge housings which conform to the shape of a manufacturer's standard, ink-filled cartridge so that the cartridge housing may be substituted for the ink-filled cartridge normally associated with the printer. Inside the housing is situated an ink pump, a reservoir, and a control circuit for operating the ink pump. The ink pump replenishes the ink reservoir in the cartridge housing, and receives ink from one of several external ink bottles, one bottle for each color and one bottle for each cartridge housing. The control circuit for operating the pump includes a high volume primary level sensing switch, which monitors the quantity of ink in the internal reservoir within the cartridge housing. The control circuit energizes or de-energizes the pump to add more ink as required to the reservoir in order to maintain a pre-determined level of ink within the reservoir. An external status indicator unit which includes a plurality of indicator lights is viewable to the operator of the printer. The lights indicate the status of the ink delivery system.

12 Claims, 4 Drawing Sheets

BULK INK DELIVERY SYSTEM FOR INK JET PRINTERS AND THE LIKE

CROSS REFERENCE TO RELATED APPLICATION

This application is based on U.S. Provisional Application Ser. No. 60/585,165, which was filed on Jul. 2, 2004, and which is entitled "Bulk Ink Delivery System For Ink Jet Printers and The Like", the disclosure of which is incorporated herein by reference. Applicants hereby claim priority to the aforementioned application under 35 U.S.C. 120.

BACKGROUND OF THE INVENTION

1. Field of the Invention

This invention relates to ink jet printers and the like, and more particularly relates to the ink cartridges and the supply of ink for such printers.

2. Description of the Prior Art

Ink jet printers, such as those which use the Seiko-Epson Writing Engine, rely primarily on one or more replaceable ink cartridges, one cartridge for each color. The cartridges contain a limited quantity of ink and must be replaced frequently. Cartridge replacement results in printer down time and disrupts the printing operation. This disruption occurs each time just one color cartridge must be changed.

External bulk ink delivery systems are well known in the art for supplying a larger quantity of ink to the printers. However, such delivery systems are most commonly passive systems, using gravity feed, capillary feed, siphons or other mechanisms, instead of active electrical/mechanical devices, to transfer ink to the printing head.

Also, such conventional ink delivery systems have inherent limitations, as their use often results in ink starvation or flooding at the printing head. These phenomena occur because the level of the ink immediately adjacent to the printing head is insufficiently maintained either due to limitations of the feed system or the need to manually adjust and replenish the ink reserves.

OBJECTS AND SUMMARY OF THE INVENTION

It is an object of the present invention to provide a bulk ink delivery system for ink jet printers and the like which maintains a constant ink level and thereby minimizes the chance of ink starvation or flooding at the printing head.

It is another object of the present invention to provide a bulk ink delivery system for ink jet printers and the like which indicates to the printer operator the status of the delivery system.

It is a further object of the present invention to provide a bulk ink delivery system for ink jet printers and the like which overcomes the inherent disadvantages of known ink delivery systems.

In accordance with one form of the present invention, a bulk ink delivery system includes one or more cartridge housings which conform to the shape of the manufacturer's standard, ink-filled cartridges so that the cartridge housing of the present invention may be substituted for the ink-filled cartridge normally associated with the printer. Inside the housing is situated an ink pump, a reservoir, and a control circuit for operating the ink pump. The ink pump replenishes the ink reservoir in the cartridge housing, and receives ink from one of several external ink bottles, one bottle for each color and one bottle for each cartridge housing. The printing head draws ink from the reservoir, as needed.

The control circuit for operating the pump includes a high volume primary level sensing switch, which monitors the quantity of ink in the internal reservoir within the cartridge housing. The control circuit is responsive to the primary level sensing switch, which is situated within the internal reservoir, and energizes or deenergizes the pump to add more ink as required to the reservoir in order to maintain a predetermined level of ink within the reservoir. The ink is withdrawn by capillary action or the like from the reservoir by the printing head, as the printing head would normally do with a standard replaceable ink filled cartridge. Thus, a steady supply of ink is provided to the printing head, as required, and the chances of ink starvation or flooding at the printing head is minimized. As a safety precaution, a fail safe or secondary level sensing switch, set to trip at a higher ink volume level than the primary level sensing switch, is provided in the reservoir of each cartridge housing, and is used as a back up switch to stop the pump from operating should the primary level sensing switch fail to deenergize the pump when it reaches its predetermined maximum level.

An external status indicator unit, which includes a plurality of indicator lights, is viewable to the operator of the printer. The lights indicate the status of the ink delivery system of the present invention, such as when the pump is energized to replenish ink to the internal reservoir for each ink color provided to the printing head.

These and other objects, features and advantages of the present invention will be apparent from the following detailed description of illustrative embodiments thereof, which is to be read in connection with the accompanying drawings.

DETAILED DESCRIPTION OF THE PREFERRED EMBODIMENTS

Figure 1:
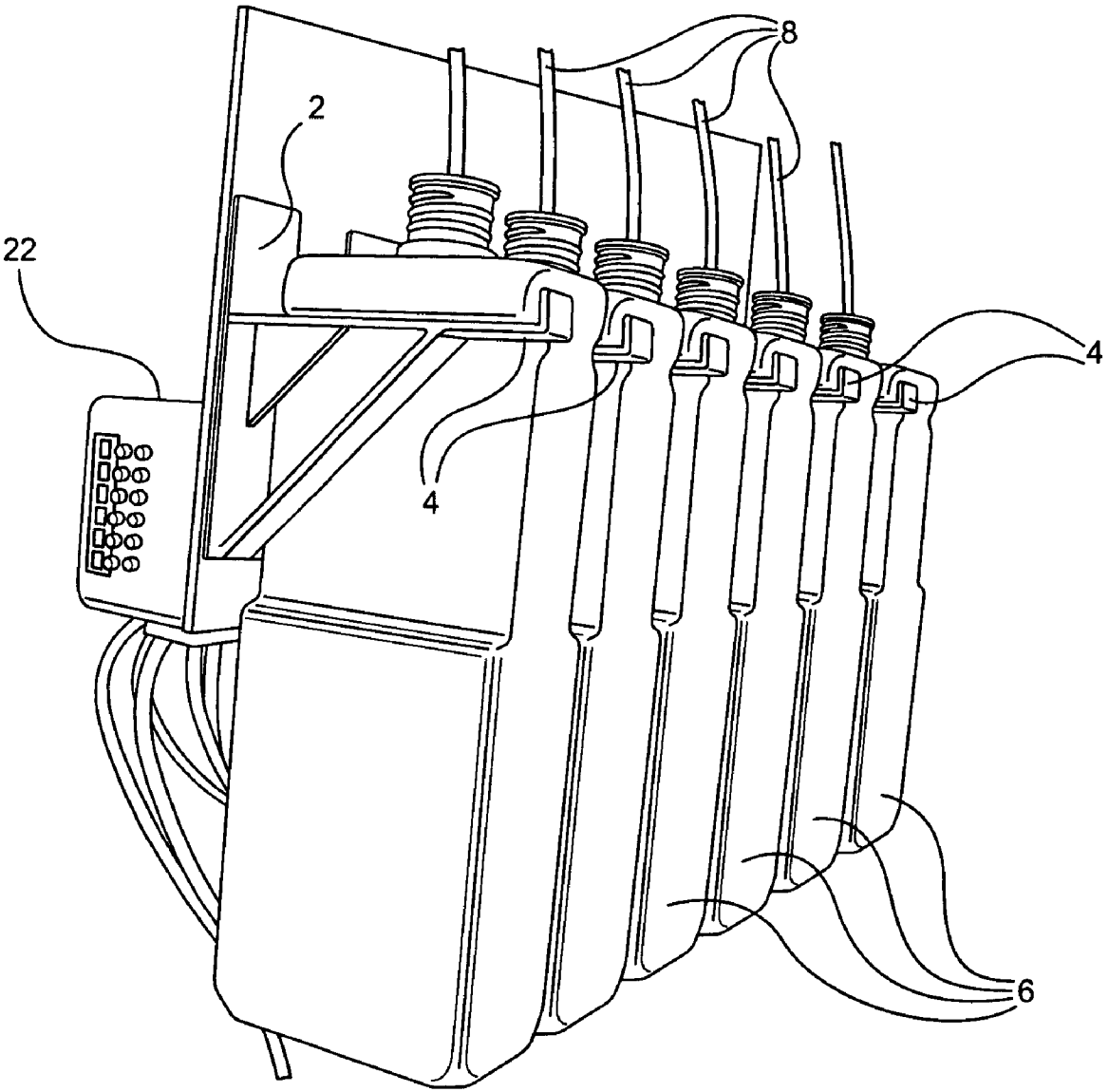
FIG. 1 is a front perspective view of a bracket which holds a plurality of external bottles of ink, which forms part of the bulk ink delivery system of the present invention.

Turning initially to FIG. 1 of the drawings, it will be seen that a bulk ink delivery system for ink jet printers and the like first includes a bracket 2 comprised of a plurality of horizontal arms 4, adjacent arms 4 being spaced apart from each other to define a space therebetween for hanging between adjacent arms a plurality of ink bottles 6. Preferably, each bottle 6 is dimensioned to hold one liter of ink. The ink bottles 6 have oppositely and outwardly extending flanges at their upper portions which allow the ink bottles to rest on and in between adjacent horizontal arms 4 of the bracket 2.

Each ink bottle 6 is provided to hold a particular color for the printer. Furthermore, each ink bottle 6 includes a tube 8 extending into the interior of the bottle and outwardly therefrom to a particular cartridge housing 10, such as that shown in FIG. 3 of the drawings. The ink bottles 6 provide an uninterrupted supply of ink to the printer, through the specially designed ink cartridge housings 10. The ink bottles 6 are easy to replace and refill, and prevent the ingestion of air pockets into the ink lines, which ensures continuous and worry free printing for hundreds of hours at a time.

Figure 3:
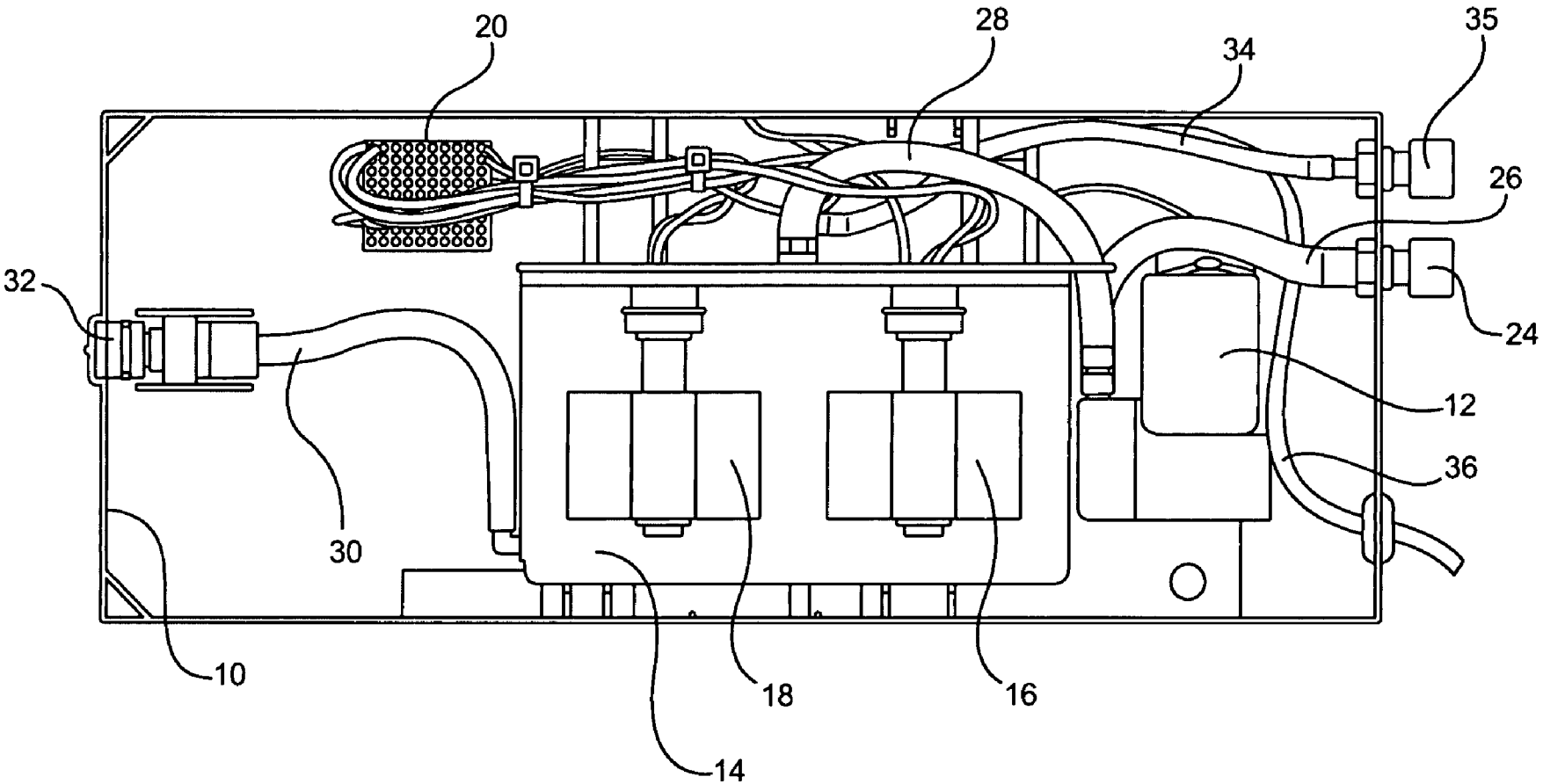
FIG. 3 is a perspective view of one half of the cartridge housing, illustrating the components which are housed therein, which forms part of the bulk ink delivery system of the present invention.

FIG. 3 of the drawings shows one half of a replacement cartridge housing 10 for the printer. Depending upon the manufacturer, each printer has an ink cartridge, or a plurality of ink cartridges, which have particular dimensions. It is envisioned to be within the scope of the present invention to design a replacement cartridge housing 10 for substitution with the original, ink-filled cartridge designed for the particular printer. Accordingly, the dimensions of the housing 10 will vary from printer to printer.

The cartridge housing 10 of the present invention includes a pump 12, an ink reservoir 14, and a pair of level sensing switches 16, 18, such as float switches, which are contained within the ink reservoir 14 of the cartridge housing 10. Also enclosed is a printed circuit board 20 which contains the electronic circuit (shown in FIG. 4) for driving the pump 12 and illuminating the status indicator lights which are found on the status indicator unit 22 shown in FIG. 2 of the drawings. There will, of course, be several cartridge housings 10, one for each color, each replacing an original equipment manufacturer's ink-filled cartridge for the printer.

The conduit 8 from a particular ink bottle 6 is provided to a connector 24 on the outside of the cartridge housing 10 and is connected thereto. The input connector 24 is connected to an internal conduit 26 which provides ink from the external ink bottle 6 to the pump 12 and, in particular, the diaphragm portion (i.e., impeller unit) thereof. The pump 12, with its pump motor driving the diaphragm, when energized, forces the ink out of an exit port in the impeller unit through another conduit 28 and into the internal reservoir 14, where the delivered ink fills the interior of the reservoir to a particular level.

First and second level sensing switches 16, 18 are provided to ensure that the level of the ink within the internal reservoir 14 is maintained at a predetermined level. The pump 12 will be energized only if the level falls below a threshold lower limit. An ink output conduit 30 is connected to the reservoir 14 at or near its lowest point and communicates with the interior thereof, and is connected to an output connector 32 on another side of the cartridge housing 10. This output connector 32 mates with another connector of the printer so that the printer may draw by capillary action or the like ink from the bottom of the reservoir 14 of the cartridge housing 10, as it would do with a conventional ink-filled cartridge which the cartridge housing of the present invention replaces.

A third conduit 34 is connected interiorly of the cartridge housing 10 between a third connector 35 on a side of the cartridge housing and the reservoir 14. The third conduit 34 is used as a vent conduit which is connected to the top wall of the reservoir 14 and which communicates with the interior thereof to vent any air and equalize the pressure within the reservoir to the ambient environment.

The two-level sensing switch system provides a safety backup feature to prevent ink starvation and flooding at the printing head. One level sensing switch 16 is used as the primary control for the operation of the pump 12, turning it on and off to refill the reservoir 14 as needed, and the other level sensing switch 18 is a back up or safety switch if the first level sensing switch 16 fails.

Although shown in FIG. 3, the ink intake conduit 28 passes through the top of the reservoir 14, the conduit may be connected to the bottom of the reservoir, below the ink level, in order to minimize agitation and the formation of bubbles in the ink. If the ink intake conduit 28 is connected to the bottom of the reservoir 14, for example, to a reservoir input port or fitting situated on one of the narrower lateral sides thereof, a short baffle wall (not shown), extending interiorly upwardly in the reservoir from the bottom wall thereof and positioned in horizontal alignment with the reservoir input port connected to the ink intake conduit 28, may be included. This baffle wall would be further preferably positioned between the reservoir ink input port and the reservoir ink output port or fitting coupled to the ink output conduit 30, and helps further to minimize agitation and the formation of bubbles in the ink close to the bottom of the reservoir 14, especially near where the ink is drawn from the reservoir by the printer through the ink output conduit 30. Also, if it is desired to connect the ink inflow conduit 28 to the top of the reservoir 14, a stem tube (not shown) extending vertically partially through the interior of the reservoir just short of the bottom of the reservoir or at least below the minimum ink level, may be connected to the top wall of the reservoir at the point that the inflow conduit is connected thereto so that replenishment ink provided to the reservoir will pass through the stem tube and will be discharged therefrom below the level of the ink and further below the lowest level that the level sensing switches 16, 18 reside in the interior of the reservoir 14.

Figure 4:
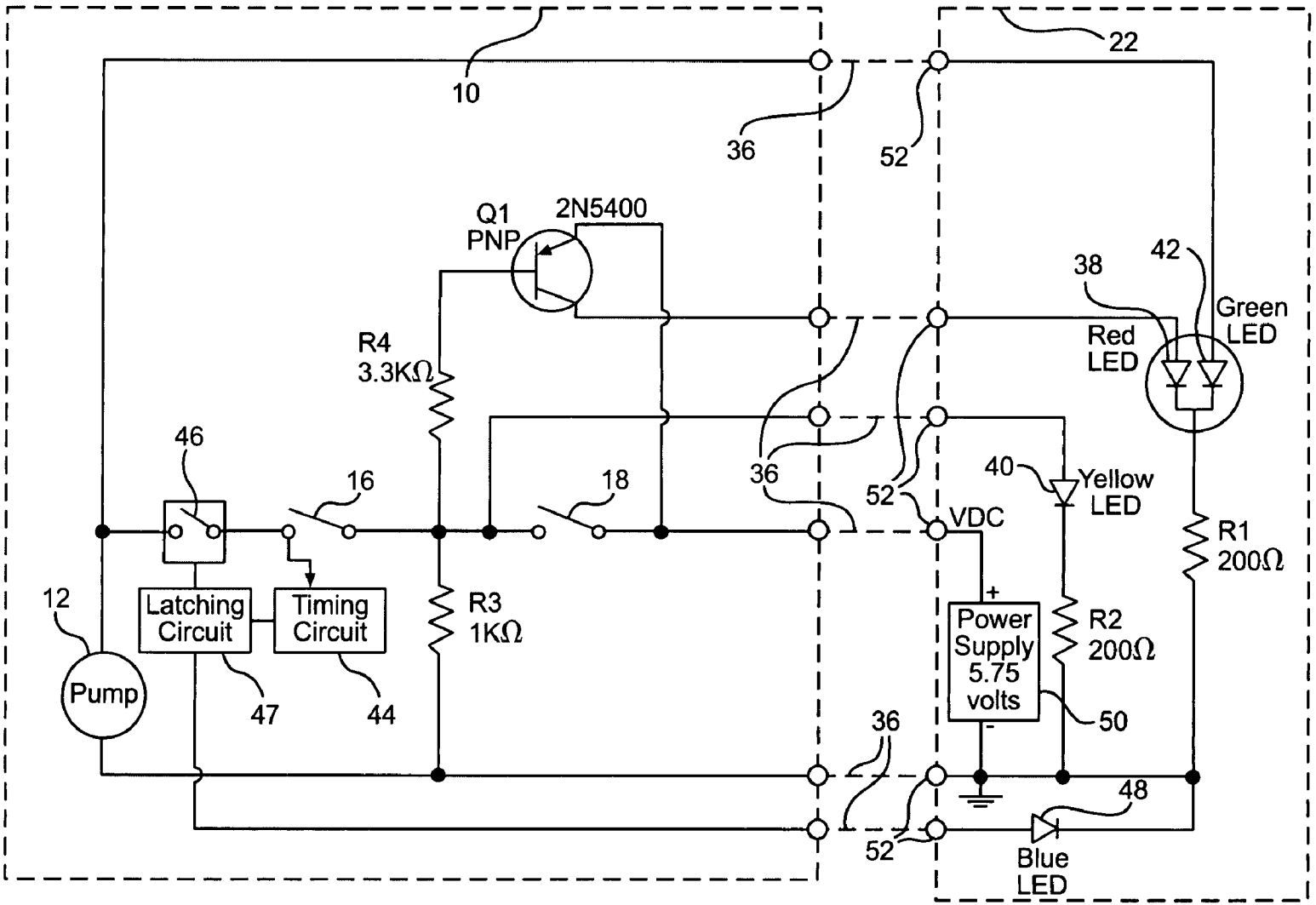
FIG. 4 is a schematic diagram of the control circuit and pump which is situated within the cartridge housing of the bulk ink delivery system of the present invention, as well as the circuitry for the status indicator unit of the present invention.

As further can be seen from FIG. 3 of the drawings, a printed circuit board 20 which contains the electronic circuitry, as shown in FIG. 4, for operating the pump 12 and illuminating the various indicator lights on the separate status indicator unit 22 is situated within the cartridge housing 10. Electrical wires, such as in a multiple conductor cable (e.g., a multiconductor telephone wire) 36, are connected to the printed circuit board 20 and carry the signals through the cartridge housing 10 and to the status indicator unit 22.

The preferred circuit for operating the pump 12 is shown schematically in FIG. 4 of the drawings. The circuit shown is for illustrative purposes only, and it is envisioned to be within the scope of the present invention to derive other circuits for operating the pump of each cartridge housing 10.

As shown in FIG. 4, a voltage (VDC), which is preferably 5.75 volts, is provided to a first contact of a single pole, single throw level sensing switch 18, which acts as the safety overflow switch, and to the emitter of a PNP transistor Q1 (preferably, Part No. 2N5400). As will be seen, the transistor Q1 is used to switch on an overflow red light emitting diode (LED) 38 when overflow conditions arise, if at all. The other contact of the safety overflow level sensing switch 18 is connected to one contact of the second, primary level sensing switch 16, which is also a single pole, single throw switch, and to the junction of resistors R3 and R4, which form a resistor divider network, as will be seen. The second contact of the safety overflow level sensing switch 18 is also provided through one wire of the multiconductor cable 36 to the anode of a yellow LED 40 situated on the status indicator unit 22, which is remotely located from the housing cartridge 10 that fits into the printer and is visible to the operator.

The base of the PNP transistor Q1 is connected to the opposite end of resistor R4, and the collector of the PNP transistor Q1 is connected through one wire of the multiconductor telephone wire 36 to the anode of the red LED 38, which when illuminated indicates an overflow condition, which red LED 38 is situated on the status indicator unit 22.

The other contact of the primary operational level sensing switch 16 is connected to one contact of the ink pump 12, which is used to replenish the ink in the reservoir 14, and is connected through another wire of the multiconductor telephone wire 36 to the anode of a green LED 42 also situated on the status indicator unit 22 of the delivery system. System ground is provided on another wire of the multiconductor telephone wire 36 to the other leg of resistor R3 and the other contact of the pump 12. System ground also is connected to one end of a current limiting resistor R2 and one end of another current limiting resistor R1. The other ends of resistors R2 and R1 are respectively connected to the cathodes of the yellow LED 40 and the red and green LEDs 38, 42, as shown in FIG. 4. Preferably, resistors R1 and R2 are 200 ohm resistors, and each of the red, yellow and green LEDs are about 2.1 volt or 2.2 volt LEDs, drawing about 20 milliamperes.

The operation of the circuit shown in FIG. 4 will now be described. Normally, the primary operational level sensing switch 16 and the safety overflow level sensing switch 18 are on (i.e., conductive) and, as can be seen from the circuit diagram of FIG. 4, are connected in series to provide 5.75 volts (the preferred voltage) through the safety level sensing switch 18 and the operational level sensing switch 16 to the pump 12. The pump 12 is driven to pump ink from a respective ink bottle 6 into the reservoir 14 at a controlled rate. The pump 12 is preferably a 12 volt pump, Model No. NF10, manufactured by KNF Flotos of Sweden, and is driven only at 5.75 volts to decrease the flow rate of ink into the reservoir 14 and to prevent agitation of the ink and formation of bubbles within the reservoir. With both level sensing switches on, which means that the ink level in the reservoir 14 is below a threshold level, ink is supplied to the reservoir to increase the level of the ink therein.

As can be seen from the circuit diagram of FIG. 4, when the pump 12 is on, voltage is supplied to the yellow LED 40 to illuminate it, which indicates that the system is functioning properly for that particular cartridge housing 10. Also, with both level sensing switches 16, 18 on, power is provided to the green LED 42 to indicate that pumping of ink is occurring with respect to that particular cartridge housing 10.

When the level of the ink in the reservoir 14 reaches a particular threshold level, the operational level sensing switch 16 will open. This breaks the connection to the 5.75 volt power supply, and the pump 12 stops running. Since the operational level sensing switch 16 now opens, no voltage is provided to the green LED 42, and the LED will de-illuminate, thus indicating that pumping has stopped for this particular cartridge housing 10.

For the conditions when 1) both level sensing switches 16, 18 are on, and 2) when the operational level sensing switch 16 is off but the overflow level sensing switch 18 is on, the PNP transistor Q1 will be back biased and, therefore, the red LED 38, which indicates an overflow condition, will remain off.

As the printer draws ink from the cartridge housing 10 and the level in the respective reservoir 14 falls below the threshold level, the primary operational level sensing switch 16 will again turn on to allow current to pass therethrough to the pump 12, energizing the pump so that the pump may refill the reservoir 14 with ink, and energizing the green LED 42 in the status indicator unit 22 to indicate that pumping for that particular cartridge housing 10 is occurring.

As mentioned previously, the safety overflow level sensing switch 18 is provided for safety purposes in the event that the operational level sensing switch 16 becomes jammed or does not open properly when the ink level within the reservoir 14 reaches the threshold level. The contact for the safety overflow level sensing switch 18 is at a higher level than the contact of the operational level sensing switch 16 and, therefore, sets an overflow threshold level in the reservoir 14. The level of the ink in the reservoir should cause the operational level sensing switch 16 to open at the normal ink threshold level. However, if for some reason this does not occur and the pump 12 remains energized, the safety overflow level sensing switch 18 will open when the ink level in the reservoir reaches the overflow threshold level. When the safety overflow level sensing switch 18 opens, it breaks the circuit providing power to the pump 12 and deenergizes the pump. It also breaks the circuit to the green LED 42, which now unlit indicates that pumping has stopped for this particular cartridge housing 10. It further breaks the circuit connection to the yellow LED 40, which no longer illuminates to indicate that the system is functioning properly.

With the safety overflow level sensing switch 18 now open, the PNP transistor Q1 is forward biased through the 5.75 volts provided to its emitter and through the resistor divider network on its base, and turns on to switch on the red LED 38 located at the status indicator unit 22 to indicate that there is an overflow condition for this particular cartridge housing 10. Preferably, resistor R4 is 3.3K ohms, and resistor R3 is 1K ohms. Resistors R3 and R4 act as a voltage divider, but also provide proper biasing for the transistor Q1 to turn it on. The voltage at the junction of resistors R3 and R4 is lower than that required to turn on the yellow LED 40 and the green LED 42 or to drive the pump 12. Thus, the green pumping LED 42 and the yellow system function LED 40 remain off, and no further ink is supplied to the reservoir 14 of the particular cartridge housing 10 when in the overflow mode. However, the red LED 38 illuminates to indicate an overflow condition to the operator. When the overflow condition is corrected, the safety overflow level sensing switch 18 will again close (i.e., its normal conductive condition), and normal operation of the pump circuit will resume.

In an alternative embodiment of the present invention, and as shown in FIG. 4, a timing circuit 44 may be included to interrupt the operation of the pump 12 if the pump has been running continuously for a predetermined period of time. More specifically, connected in series between the pump 12 and the operational level sensing switch 16 may be a single pole, single throw electronic switch 46 which is controlled by a timing circuit 44, such as an NE555 timer, for example. The electronic switch 46 may be a switching transistor circuit, or a relay controlled by a transistor drive circuit, or the like. The timing circuit 44 may be triggered whenever the operational level sensing switch 16 turns on, and may be set to provide a two minute pulse to the electronic switch 46, turning the switch on for no more than two minutes, for example. After two minutes has elapsed, the output pulse from the timing circuit 44 ends, causing the electronic switch 46 to open. The timing circuit 44 will be retriggerable every time the operational level sensing switch 16 closes and, because the electronic switch 46 is in series with the operational level sensing switch 16, the operational level sensing switch will still control the energization of the pump 12 during the two minute window provided by the timing circuit 44 and the electronic switch 46. If the pump 12 remains running for more than two minutes, the electronic switch 46 will break the circuit to the pump to deenergize it.

It is also envisioned that the timing circuit 44 can interrupt the power circuit to the pump 12 if more than a predetermined period of time, such as two minutes, has elapsed during a single continuous pumping cycle. The timing circuit 44, activated upon closure of the operational level sensing switch 16, would cause a latching circuit 47, such as a bistable multivibrator or flip flop, connected thereto and controlling the electronic switch 46 to latch the switch in an open condition, thus breaking the circuit to the pump 12, if the operational level sensing switch 16 remains on for more than two minutes. The latching circuit 47 could also drive and be connected to the anode of another LED, such as a blue LED 48, to indicate that an error has occurred in that the pump 12 was running continuously for more than a predetermined amount of time. The pump 12 will, of course, stop functioning when the electronic switch 46 opens. The blue LED 48 will indicate to the operator that a malfunction has occurred, or there is something wrong with the pump 12 of that particular cartridge housing 10. A switch (not shown) may be provided to the reset input of the latching circuit and may be activated by the operator after he has inspected the cartridge housing 10 and the operation of the pump 12 and the control circuit for the pump.

The timing circuit 44 provides another safety feature to the ink delivery system of the present invention. It ensures that the pump 12 will not run continuously for more than a predetermined period of time, thus further preventing an overflow condition.

Figure 2:
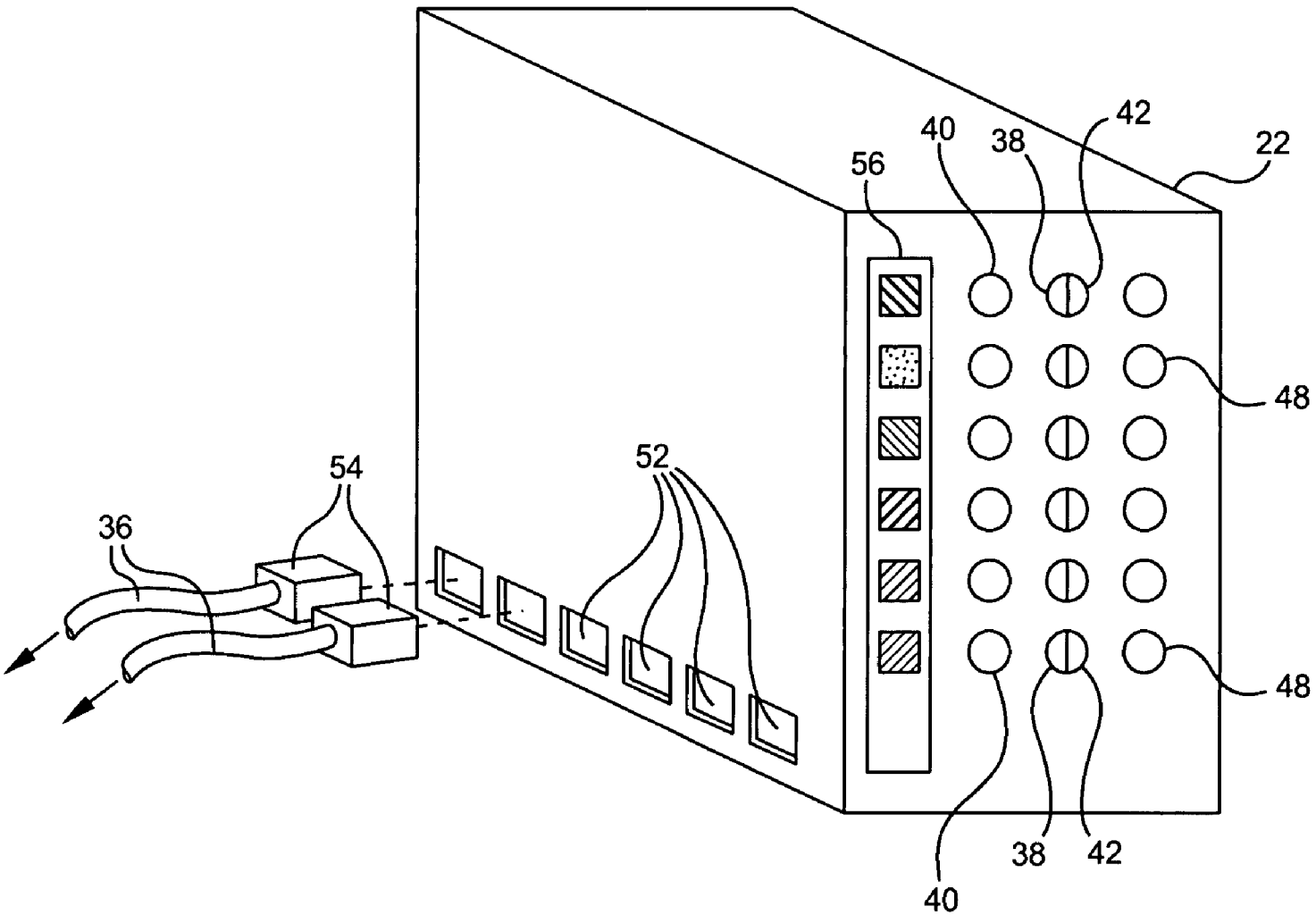
FIG. 2 is a front perspective view of a status indicator unit forming part of the bulk ink delivery system of the present invention.

The status indicator unit 22 is illustrated by FIG. 2 of the drawings. It basically includes a power supply 50, which generates 5.75 volts DC (direct current), which is provided through the multiconductor cable 36 to each of the cartridge housings 10. The status indicator unit 22 also includes a plurality of modular connectors 52, one for each cartridge housing 10, which receives the modular jack connector 54 of each multiconductor cable 36 from each cartridge housing. The female connectors 52 which receive the modular jack connectors 54 are wired to the power supply 50 and to respective red, yellow and green (and optionally blue) LEDs 38, 40, 42, 48 for each of the cartridge housings 10. If desired, a color coded label 56 may be positioned next to each row of LEDs associated with a respective ink bottle 6 so as to identify the particular cartridge housing connected to a corresponding ink bottle and associated with a particular row of colored LEDs.

The operator may easily view the rows and columns of LEDs 38, 40, 42, 48 to determine the operational status of each cartridge housing 10 and whether such is functioning properly. Also, because the ink bottles 6 are viewable to the user, and are at least partially translucent or transparent, the operator may easily determine whether a particular ink bottle must be replaced.

The bulk ink delivery system of the present invention minimizes any interruption in the operation of the ink jet printer or the like. The status of each cartridge housing 10 is indicated by its associated LEDs 38, 40, 42, 48, which are viewable remotely by the operator on the status indicator unit 22. Ink starvation and overflow conditions are virtually eliminated. The redundancy in the level sensing switches 16, 18 addresses situations where the primary operational level sensing switch 16 fails. The level of ink in the separate ink bottles 6 is viewable by the operator so that he may easily replace or refill bottles, as required, with little or no interruption to the printing operation.

Because the cartridge housings 10 have the same dimensions, and configurations, and placement of the connectors 24, 32, 36 as the original equipment, ink-filled cartridges they replace, the operator can easily substitute the cartridge housing 10 of the present invention with the original equipment ink-filled cartridges.

It should be noted that FIG. 3 shows one end of the multiconductor cable 36 passing through a grommet lining an opening formed through the thickness of the wall of the cartridge housing 10, with the individual conductors being hard-wired to the printed circuit board 20. An alternative to this would be to have modular jack connectors 54 at both ends of the multiconductor cables 36 so that the jack connectors mate with female connectors 52 not only on the status indicator unit 22, as shown in FIG. 2, but also on the ink cartridge housings 10, in place of the multiconductor cable 36 passing through the grommeted housing opening. The female connectors 52 on the cartridge housings 10 would be wired directly to the printed circuit boards 20. In this way, the multiconductor cables 36 may be separable from the cartridge housings 10 and may be used with any of the cartridge housings, reused if a cartridge housing is replaced, or replaced by a different cable independently of the cartridge housing.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A bulk ink delivery system for a printer, which comprises:

at least one ink cartridge housing;

an ink pump situated within the ink cartridge housing;

an ink reservoir for holding ink, the ink reservoir being in fluid communication with the ink pump;

a control circuit for operating the ink pump, the control circuit including at least a first ink level sensing switch, the first ink level sensing switch being responsive to a first threshold level of ink held by the ink reservoir and selectively energizing and de-energizing the ink pump in response thereto; and a status indicator unit, the status indicator unit having at least a first light emitting device, a second light emitting device and a third light emitting device, each of the first, second and third light emitting devices emitting a different color light than any other of the first, second and third light emitting devices, the control circuit providing a first signal to the first light emitting device, the first light emitting device indicating whether the ink pump is energized and de-energized in response to the first signal, the control circuit providing a second signal to the second light emitting device, the second light emitting device indicating a normal and an abnormal condition with respect to the operation of at least one of the ink pump, the ink reservoir and the control circuit in response to the second signal, the control circuit providing a third signal to the third light emitting device, the third light emitting device indicating at least an abnormal condition with respect to the at least first ink level sensing switch in response to the third signal.

2. A bulk ink delivery system for a printer as defined by claim 1, which further comprises an ink container for holding a volume of ink, the ink container being externally situated with respect to the ink cartridge housing, the ink container being in fluid communication with the ink pump and providing ink to the ink reservoir when the ink pump is energized by the control circuit.

3. A bulk ink delivery system for a printer as defined by claim 1, wherein the at least first ink level sensing switch is situated within the ink reservoir.

4. A bulk ink delivery system for a printer as defined by claim 3, wherein the at least first ink level sensing switch is a float switch.

5. A bulk ink delivery system for a printer, which comprises:

at least one ink cartridge housing;

an ink pump situated within the ink cartridge housing;

an ink reservoir for holding ink, the ink reservoir being in fluid communication with the ink pump; and a control circuit for operating the ink pump, the control circuit including at least a first ink level sensing switch, the first ink level sensing switch being responsive to a first threshold level of ink held by the ink reservoir and selectively energizing and de-energizing the ink pump in response thereto;

wherein the control circuit further includes a timing circuit, the timing circuit being responsive to the at least first ink level sensing switch and selectively controlling the energization and de-energization of the ink pump in response thereto;

wherein the at least first ink level sensing switch is in at least one of a first state and a second state, the first state of the at least first ink level sensing switch corresponding to the ink held by the ink reservoir being less than the first ink threshold level, and the second state of the at least first ink level sensing switch corresponding to the ink held by the ink reservoir being at least equal to the first ink threshold level, the timing circuit de-energizing the ink pump when the at least first ink level sensing switch is in the first state more than a predetermined continuous period of time; and wherein the control circuit further includes a latching circuit, the timing circuit providing a signal to the latching circuit, the latching circuit de-energizing the ink pump in response to the signal from the timing circuit until the latching circuit is reset.

6. A bulk ink delivery system for a printer as defined by claim 5, which further comprises an indicator, the latching circuit providing a signal to the indicator, the indicator indicating when the latching circuit has de-energized the ink pump in response to the signal.

7. A bulk ink delivery system for a printer as defined by claim 5, which further comprises an ink container for holding a volume of ink, the ink container being externally situated with respect to the ink cartridge housing, the ink container being in fluid communication with the ink pump and providing ink to the ink reservoir when the ink pump is energized by the control circuit.

8. A bulk ink delivery system for a printer as defined by claim 5, wherein the at least first ink level sensing switch is situated within the ink reservoir.

9. A bulk ink delivery system for a printer as defined by claim 8, wherein the at least first ink level sensing switch is a float switch.

10. A bulk ink delivery system for a printer as defined by claim 5, which further comprises a status indicator unit, the status indicator unit having at least one indicator situated thereon, the control circuit providing a signal to the at least one indicator, the at least one indicator indicating a condition of at least one of the ink pump, ink reservoir, the control circuit and the at least first ink level sensing switch in response to the signal.

11. A bulk ink delivery system for a printer as defined by claim 10, wherein the at least one indicator is a visual indicator.

12. A bulk ink delivery system for a printer as defined by claim 10, wherein the at least one indicator is a light emitting device.

* * * * *